US006190272B1

(12) United States Patent
Bernard

(10) Patent No.: US 6,190,272 B1
(45) Date of Patent: Feb. 20, 2001

(54) SOCCER-GOLF

(76) Inventor: Glenn R. Bernard, 4640 Huggins St., San Diego, CA (US) 92122

( * ) Notice: Under 35 U.S.C. 154(b), the term of this patent shall be extended for 0 days.

(21) Appl. No.: 09/201,558

(22) Filed: Nov. 30, 1998

(51) Int. Cl.[7] ..... A63B 67/02

(52) U.S. Cl. ..... 473/471; 473/169; 473/478; 273/400

(58) Field of Search ..... 473/168–170, 473/180, 185, 150, 409

(56) References Cited

U.S. PATENT DOCUMENTS 3,427,030 * 2/1969 Ward ..... 473/169
3,942,801 * 3/1976 Mintz ..... 473/169

* cited by examiner

*Primary Examiner*—Mark S. Graham
(74) *Attorney, Agent, or Firm*—John R. Ross; John R. Ross, III

(57) ABSTRACT

A method for playing a sport that includes the following steps: (1) a fee is paid by a player, (2) the player places a ball on the ground at the beginning of a course (the course contains a plurality of goals), (3) the player kicks the ball towards the first of the goals, (4) the player scores a goal by kicking his ball into the first goal, (5) the player tabulates the number of kicks required to score the goal, (6) the player records the results of his tabulation and assigns one point for each kick required, (7) the player moves to the next goal and repeats steps 3–6 for each successive goal until the course is complete, and (8) the player determines his final score by adding the number of points required to complete the course. The player with the lowest point total is the winner.

8 Claims, 3 Drawing Sheets

SOCCER-GOLF

This application relates to sports and more particularly to a method and to equipment for playing a sport that is a combination of soccer and golf.

BACKGROUND OF THE INVENTION

Soccer is a sport that is extremely popular throughout the world. Statistics indicate that over one billion television viewers watch soccer each year. Although it's in its infancy, America's first professional soccer league (MLS®) is proving to be both popular and profitable. In addition, children throughout the United States, as well as the rest of the world, participate in organized soccer leagues starting at age five and continuing through college. Equipment needed for playing soccer is very inexpensive. Unfortunately, however, the average adult finds it difficult to play soccer for the following reasons:

1. There are a limited number of organized adult soccer leagues.
2. Work schedules, family responsibilities and other time constraints make it difficult for twenty-two adults (eleven for each team) to gather and play a game of soccer.
3. Adults often have limited athletic ability and/or cardiovascular fitness, making a normal game of soccer difficult and potentially unsafe, or even impossible.

In contrast, golf is a sport that adults can enjoy not only as a spectator, but also as a participant. Like soccer, it is extremely popular to watch professional golf on television. Unlike soccer, adults all over the world play golf well into their old age. Indeed, many adults take up golf for the first time as an adult, never having played golf as a child. The reasons for the popularity of playing golf amongst adults is as follows:

1. Golf can be played with a very small number of people (i.e., a foursome, a twosome, or even as a solitary activity). Therefore, belonging to an organized league is unnecessary.
2. Because only a small number of people are required, a game of golf is easy to organize around the working schedules and other responsibilities of the players.
3. To enjoy golf, or even to be skilled at golf, it is not necessary that a player has great agility or be in excellent cardiovascular shape.

A major problem with golf is its cost. Golf equipment is expensive, as are green fees and club memberships. Fees are high because golf courses require high investments in the cost of land, construction and maintenance, while allowing only a very limited number of people to play a course simultaneously.

What is needed is an improved sport that combines the benefits of soccer and golf.

SUMMARY OF THE INVENTION

The present invention provides a method for playing a sport that includes the following steps. (1) a fee is paid by a player, (2) the player places a ball on the ground at the beginning of a course (the course contains a plurality of goals), (3) the player kicks the ball towards the first of the goals, (4) the player scores a goal by kicking his ball into the first goal, (5) the player tabulates the number of kicks required to score the goal, (6) the player records the results of his tabulation and assigns one point for each kick required, (7) the player moves to the next goal and repeats steps 3–6 for each successive goal until the course is complete, and (8) the player determines his final score by adding the number of points required to complete the course. The player with the lowest point total is the winner.

DETAILED DESCRIPTION OF THE PREFERRED EMBODIMENT

Soccer Ball Replaces Golf Ball

In the present invention, substantially all the rules (and hazards) of golf apply, except that a soccer ball replaces the golf ball. Also, the players use their legs and feet in lieu of golf clubs.

First Preferred Embodiment

In the first preferred embodiment, the game starts on the first tee of a regulation golf course. Preferably, the "Tee Shot" is the only kick where players may choose to use their hands to hold the ball. In other words, a player may punt the ball from the tee. The ball is then kicked down the fairway toward, and ultimately into, a portable mini-goal 1 (FIG. 1) located on the putting green. As in golf, each player keeps a count of the number of kicks needed to successfully place the ball into the goal, and will then mark his scorecard accordingly. The player with the lowest score wins.

It should be noted that any ball that makes it up and over bump-obstacle 3 (FIG. 1) and that also stays in the score zone is a score, even if the ball never touches any part of the net structure. By referring to FIG. 1, the score zone is defined as the area between bump-obstacle 3 and net 1. Conversely, if a ball should make contact with any portion of net 1, but is moving with too much speed or too much force to stay inside the score zone, such that the ball bounces back over bump-obstacle 3, there is no score and the player has to try again.

Figure 1:
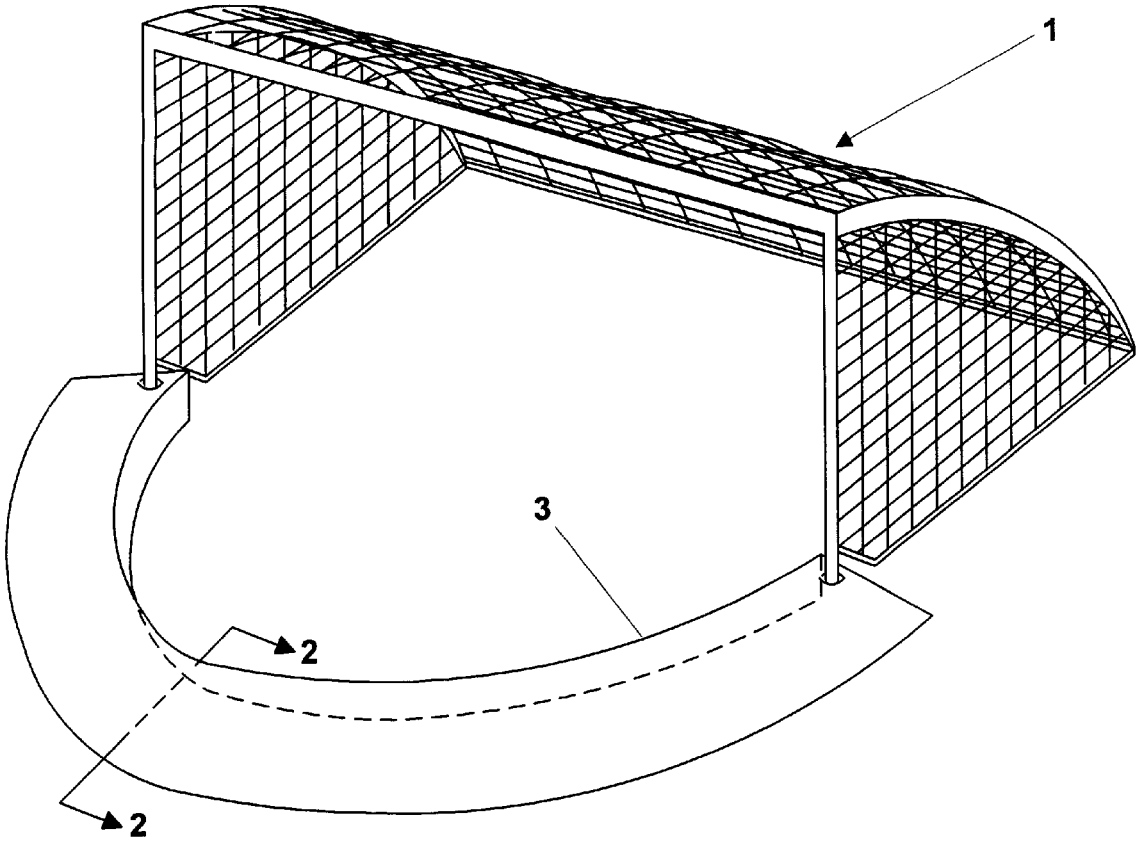
FIG. 1 shows a preferred embodiment of the Soccer-Golf goal.

An important feature of the highly-curved bump-obstacle 3 shown in FIG. 1 is that it enables a player to score a goal from the sides of the net, and even from behind the net (similar to basketball scores from behind and over the basketball backboard).

This embodiment requires each player to pay fees to the golf course, either on a per-game basis or on an annual basis, or perhaps a combination of both forms of payment.

Other embodiments of this invention described below utilize goals other than the soccer type goal, including the standard golf hole already on the golf green.

The advantages of this embodiment reside not only in the fact that it brings a soccer ball to a golf course, but that a soccer-type goal is also brought to the golf course. Avid soccer players will definitely get enjoyment out of kicking a soccer ball into a soccer-type net. Also, they will enjoy kicking the ball over a replacement for the human goalkeeper, bump-obstacle 3.

The Goal for the First Preferred Embodiment

Figure 2:
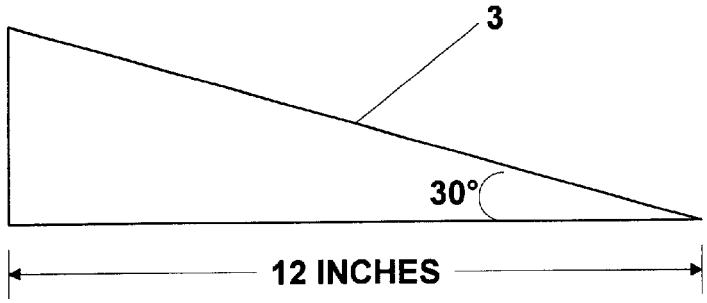
FIG. 2 shows a cross-section view of the bump-obstacle.

Goal 1 has the following approximate dimensions: height=four feet, width=six feet, and depth (measured from the base of the goal)=four feet. Bump-obstacle 3 is rigidly attached to goal 1. As shown in FIG. 2, bump-obstacle 3 has a base that is approximately twelve inches long. In the preferred embodiment, goal 1 is press fit into bump-obstacle 3, as shown in FIG. 1. Bump-obstacle 3 has a ramp that forms a slope of approximately thirty degrees, as shown in FIG. 2. Bump-obstacle 3 permits a ball that is kicked into goal 1 to roll up the ramp and into the score zone. The distance from the top of bump-obstacle 3 to the ground is approximately six inches. This distance is sufficient to stop a scored ball from rolling out of the score zone.

Goal 1 also has a net 4 that is connected to goal 1 as shown in FIG. 1. Net 4 helps prevent the ball from rolling out of goal 1.

It is important that goal 1 is sturdy and heavy enough so that it can withstand the impact of a fast moving ball. In its preferred embodiment, the frame of the goal is to be fabricated from wood.

It should be noted that it is much easier to kick a soccer ball into goal 1 than it is to sink a golf ball into a regulation size golf hole. In other words, in golf only a very skilled golfer can consistently sink a nine-foot put. However, in Soccer-Golf with goal 1, approximately 95% of the players will be able to kick a soccer ball into goal 1 from 9 feet away consistently. Nevertheless, scores in Soccer-Golf should be close to that of traditional golf because a golf ball hit hard with a golf club can travel much further than a soccer ball kicked with a foot. For example, a strong golfer can easily drive a golf ball over 250 yards. However, a strong kicker can kick a soccer ball only about 100 yards on a level grassy field. Therefore, with goal 1, what the Soccer-Golfer will lose on the fairway to the traditional golfer, he will make up on the putting green.

Second Preferred Embodiment

Figure 5A:
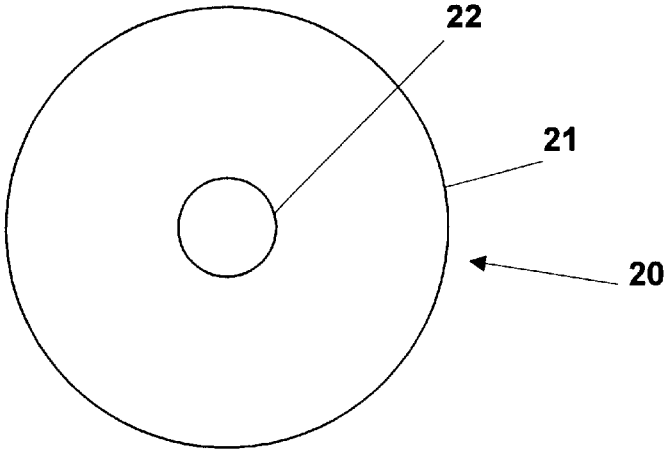
FIGS. 5A and 5B show the top and side view of another preferred embodiment of a Soccer-Golf goal. .
Figure 5B:
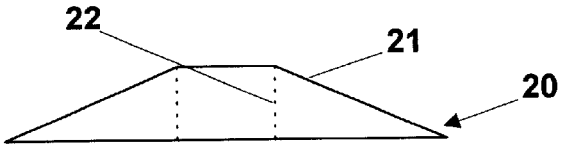

The second preferred embodiment is substantially the same as the first preferred embodiment except that goal 1, shown in FIG. 1, is replaced by goal 20, shown in FIGS. 5A and 5B. FIG. 5A shows a top view and FIG. 5B shows a side view of goal 20. Goal 20 has ramp 21 completely surrounding scoring tube 22. Ramp 21 and scoring tube 22 are both connected to circular base 23. In this embodiment, goal 20 is stood on the green. Preferably, Goal 20 has at least some flexibility so as to ensure that the entire bottom edge of the circular ramp touches the ground even in those locations where the ground is not absolutely flat. When trying to score, the player will kick the ball up ramp 21 and into scoring tube 22. In a preferred embodiment, circular base 23 has a diameter of about 6 feet and scoring tube 22 has a diameter of about 20 inches. The advantage of this embodiment is that the player can approach the goal from any angle, as is the case in golf.

Third Preferred Embodiment

While the previous preferred embodiments have discussed the present invention being utilized on a regulation golf course, it should be noted that it is possible to play Soccer-Golf at the beach, park, backyard, school playground, or any other desirable open-space area. In this embodiment, the players will need to purchase the goals disclosed in FIGS. 1 or 5A–5B. Then, with a soccer ball, they can play Soccer-Golf following the procedures discussed above.

Fourth Preferred Embodiment

In the fourth preferred embodiment, Soccer-Golf is played on a regulation golf course (similar to the first and second preferred embodiments). However, no special goals are required to play this version. Players substantially follow the formats described above, except that their purpose is to now kick the ball so that the ball will come to rest atop the existing, small hole used for golf. In this specification and in the claims a reference to kicking the ball "in" a goal should be understood to include a soccer ball settled on a golf hole with only a small portion of the ball "within" the hole. This is the only embodiment where Soccer-Golfers and traditional golfers can play together in a foursome, and use the same goal (i.e., hole).

This embodiment contrasts with the first embodiment in another way. Here, kicking a soccer ball so that it will rest atop the small hole used for golf is approximately as difficult as sinking a putt. For example, Applicant is a golfer of average skill and a kicker of average skill. Applicant has experimented with a traditional golf hole and has determined that the probability of kicking the ball onto the hole at a variety of distances is about the same as the probability of him sinking a golf ball at similar distances shown in Table 1. However, downhill greenshots with a soccer ball are very difficult.

TABLE 1

APPROXIMATE PROBABILITY OF SUCCESS

| Distance | Soccer Ball into Goal | Golf Ball into Hole |
|---|---|---|
| 1 foot | 100% | 90% |
| 3 feet | 60% | 50% |
| 10 feet | 5% | 10% |
| 30 feet | >.5% | >.5% |
| 50 yards | Almost zero | Almost zero |

Fifth Preferred Embodiment

The fifth preferred embodiment is substantially the same as the fourth preferred embodiment, except that, in the fifth preferred embodiment, Soccer-Golf is played somewhere other than a regulation golf course (i.e., at the park, in someone's backyard, at the school playground, or another open-space area). In this embodiment, the players are to dig a hole in the ground in order to form the goal. Preferably, the hole will be substantially the size of the small hole found on the green at a regulation golf course so that the soccer ball will come to rest atop the hole. However, it could be larger so that the entire soccer ball could completely drop into the hole.

Other Embodiments

Scoring

In the previous embodiments, the winner was described as the player who has been able to score goals with the least number of kicks. Another method of scoring is available to those who are in good physical shape, and want to do either some running on the course, or, at a minimum, some very fast walking. This method would take into account the length of time necessary to complete the course in order to compute a final score. For example, consider the following scenario: Two players play an 18-hole Soccer-Golf match. Player A needed 72 kicks and 71 minutes to complete the course. Player B needed 76 kicks and 40 minutes to complete the course. If a point is added for each five minutes of play, Player A's total score is 72+14=86. Player B's total score is 76+8=84. Player B wins. In this embodiment, Golf course owners may decide to exclusively reserve the entire golf course for this fast-paced activity during a one-hour or two-hour time span.

The Kit

In another preferred embodiment, a kit for playing Soccer-Golf can be manufactured and sold. The kit would contain four Soccer-Golf balls, each ball having a unique color. Hence, each player in a foursome could then choose his own ball and easily distinguish his ball from the other players during the course of play.

The Ball

Figure 3:
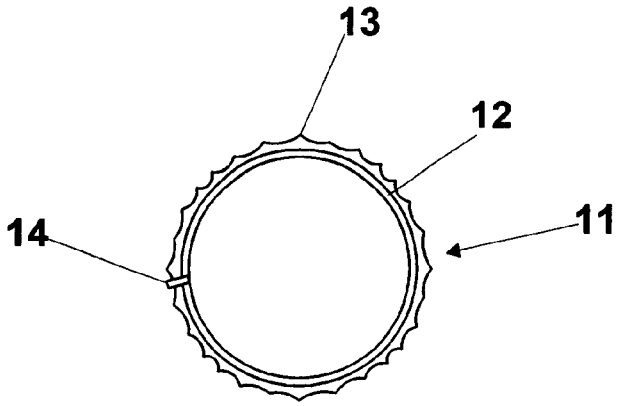
FIG. 3 shows a cross-section view of a Soccer-Golf ball.

In a preferred embodiment, the Soccer-Golf ball was described as being a regulation soccer ball. However, Soccer-Golf can be played with many other types of balls as well, such as a kickball or handball. Ideally the ball should be inflatable and kickable. A cross-section of a ball specifically designed for Soccer-Golf is illustrated in FIG. 3. Air is pumped into ball 11 through nozzle 14 to inflate the ball. Air is contained in rubber section 12. Leather section 13 is sewn around rubber section 12. As seen in FIG. 3, leather section 13 is pockmarked to resemble the markings of a golf ball. The new look is that of a very large golf ball, which is humorous, but also functional. The functionality lies in the fact that the aerodynamic qualities of the Soccer-Golf ball are improved in the same manner that the markings on the golf ball improve the aerodynamic qualities of a golf ball.

The Bump-Obstacle

Figure 4:
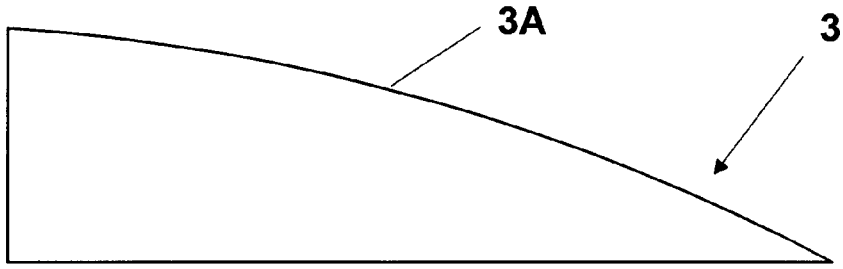
FIG. 4 shows a bump-obstacle that is concave.
Figure 7:
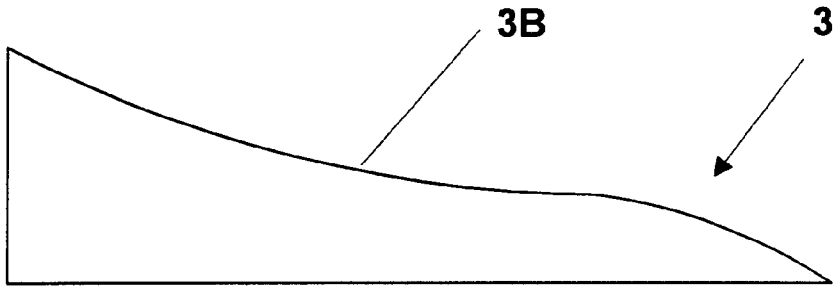
FIG. 7 shows another preferred embodiment for the bump-obstacle.

The preferred embodiment shown in FIG. 2 depicted a ramp on bump-obstacle 3 that was a straight line. However, it is possible to have a concave ramp 3A, as shown in FIG. 4. With this design, bump-obstacle 3 closely resembles one-half of a speed bump. Or, it is also possible to have wavy triangular ramp 3B as shown in FIG. 7.

Also, FIG. 2 depicts bump-obstacle 3 with a bottom side length of approximately twelve inches, a slope of thirty degrees, and a top-to-bottom length of approximately 6 inches. Those of ordinary skill in the art will recognize that it is possible to lengthen or shorten the ramp and vary the slop as well. However, the distance from the top of the bump-obstacle to the ground should always be at least 3 inches to prevent the Soccer-Golf ball from rolling out of the score zone.

Other Modifications

Figure 6:
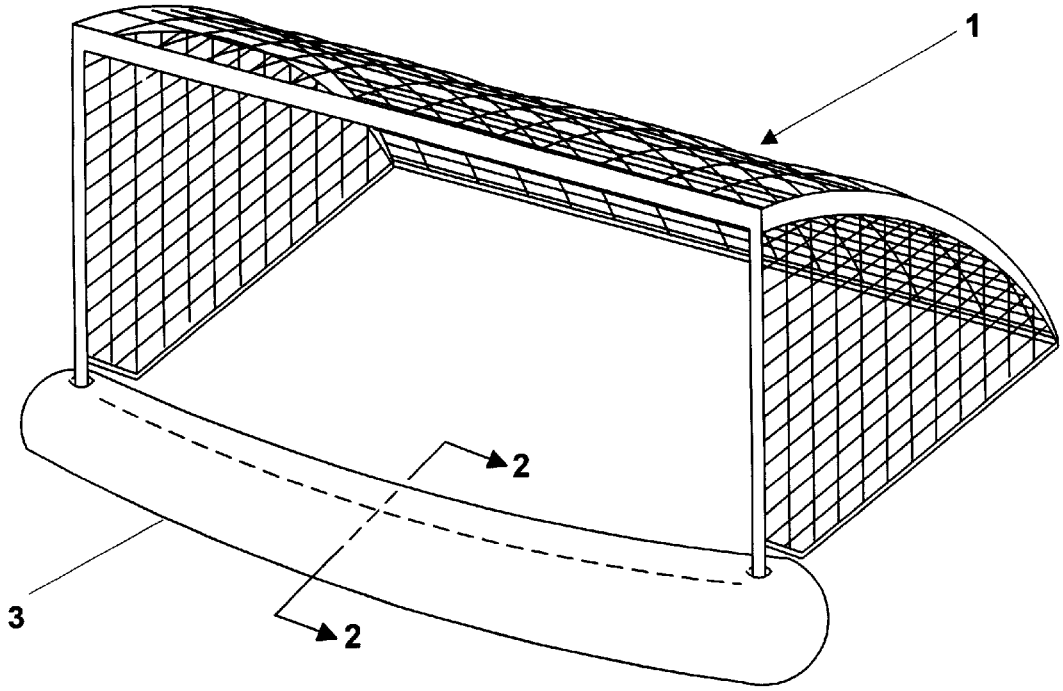
FIG. 6 shows another preferred embodiment for the Soccer-Golf goal utilizing a non-curved bump-obstacle.

In addition to the previous embodiments, other modifications of the present invention are possible. For example, while the above embodiments discussed placing a goal on the putting green of a golf course, it is also possible to place a goal near the putting green to avoid damage to the green or interference with golf balls. Also, it is possible for individuals who are confined to wheelchairs to play Soccer-Golf. Instead of kicking the ball, they can hit it with their fists or with a bat. In a preferred embodiment, it was stated that goal 1 is fabricated from wood. However, it is also possible that goal 1 can be fabricated from plastic, aluminum, tin, fiberglass, a composite, a metal alloy, or any other material that is sturdy and allows for easy assembly and disassembly. In the preferred embodiments, goal 1 was shown as having a bump-obstacle 3 that was concave, as shown in FIG. 1. However, it is also possible to have a bump-obstacle 3 that is straight or nearly straight as shown in FIG. 6. In the preferred embodiment, a pockmarked Soccer-Golf ball was described as having an outside made of leather. However, it possible that the outside of the ball can be made from a different material, such as plastic, cloth, or rubber or another similar material.

While the above description contains many specifications, the reader should not construe these as limitations on the scope of the invention, but merely as exemplifications of preferred embodiments thereof. Those skilled in the art will envision many other possible variations are within its scope. Accordingly the reader is requested to determine the scope of the invention by the appended claims and their legal equivalents, and not by the examples which have been given.

I claim:

1. A method of playing a sport on a course comprising a plurality of fairways, each fairway having associated with it a tee area and a goal, said method comprising the steps of:

A. paying a fee,

B. placing a ball in the tee area associated with the first fairway,

C. kicking the ball into the fairway toward the goal associated with said first fairway D. successfully kicking the ball toward said associated goal until the ball has been kicked into said associated goal, E. recording the number of kicks required to kick the ball into the associated goal, F. repeating steps B) through E) for all of said plurality of fairways, and G. adding up the total number of kicks required with respect to all of said fairways, wherein said goal comprises:

A. a goal frame,

B. a net connected to said goal frame,

C. a bump-obstacle rigidly connected to said goal frame at the base of said goal frame, wherein said bump-obstacle comprises:

i. a sloped ramp, to allow said ball to roll into said goal, ii. a vertical back, to prevent said ball from rolling out of said goal.

2. A method as in claim 1, wherein said vertical back is at least three inches in height.

3. A method as in claim 1, wherein said sloped ramp is concave.

4. A method as in claim 1, wherein said course is a regulation golf course.

5. A method as in claim 1, wherein said course is an open area.

6. A method as in claim 1, wherein said ball comprises,

A. an inner rubber section to contain compressed air,

B. an outer leather section that encircles said inner rubber section, wherein said outer rubber section is pockmarked to resemble the markings of a golf ball, and C. a nozzle inserted through said outer leather section and rigidly connected to said inner section, wherein compressed air is inserted into said ball through said nozzle.

7. A method as in claim 1, further comprising the step of assigning to each player points indicative of the amount of time required to complete said playing course.

8. A method as in claim 7, wherein said assigning to each player points is achieved by assigning one point for each five minutes of time required to complete the course.

* * * * *